US006703770B2

(12) United States Patent
Suzuki et al.

(10) Patent No.: US 6,703,770 B2
(45) Date of Patent: Mar. 9, 2004

(54) SPARK PLUG ATTACHMENT STRUCTURE AND SPARK PLUG THEREFOR

(76) Inventors: Akira Suzuki, c/o NGK Spark Plug Co., Ltd., 14-18, Takatsuji-cho, Mizuho-ku, Nagoya-shi, Aichi 467-8525 (JP); Takahiro Suzuki, c/o NGK Spark Plug Co., Ltd., 14-18, Takatsuji-cho, Mizuho-ku, Nagoya-shi, Aichi 467-8525 (JP); Kazumi Kawamura, c/o NGK Spark Plug Co., Ltd., 14-18, Takatsuji-cho, Mizuho-ku, Nagoya-shi, Aichi 467-8525 (JP); Kazuya Iwata, c/o NGK Spark Plug Co., Ltd., 14-18, Takatsuji-cho, Mizuho-ku, Nagoya-shi, Aichi 467-8525 (JP)

( * ) Notice: Subject to any disclaimer, the term of this patent is extended or adjusted under 35 U.S.C. 154(b) by 103 days.

(21) Appl. No.: 10/119,716

(22) Filed: Apr. 11, 2002

(65) Prior Publication Data

US 2002/0149308 A1 Oct. 17, 2002

(30) Foreign Application Priority Data

Apr. 12, 2001 (JP) ..... 2001-113632

(51) Int. Cl.[7] ..... H01T 13/20

(52) U.S. Cl. ..... 313/141; 313/118; 313/122; 313/143; 123/169 R; 123/169 EC; 123/169 EL; 123/169 PH; 123/169 EB

(58) Field of Search ..... 123/169 R, 169 EB, 123/169 EC, 169 PH, 169 EL; 313/118, 122, 143, 141

(56) References Cited

U.S. PATENT DOCUMENTS

| | | | | | |
|---|---|---|---|---|---|
| 424,027 | A | * | 3/1890 | Roberts | 52/448 |
| 2,693,082 | A | * | 11/1954 | Arthur | 60/39.827 |
| 5,091,672 | A | * | 2/1992 | Below | 313/143 |
| 5,101,783 | A | * | 4/1992 | Car et al. | 123/310 |
| 5,186,132 | A | * | 2/1993 | Runge | 123/169 R |

* cited by examiner

*Primary Examiner*—Nimeshkumar D. Patel
*Assistant Examiner*—Holly Harper
(74) *Attorney, Agent, or Firm*—Sughrue Mion, PLLC

(57) ABSTRACT

A spark plug has a central electrode, an insulator surrounding the central electrode and a metallic shell retaining therein the insulator and provided with no thread thereon. The spark plug is clearance fitted in a plug hole of a cylinder head, without being screwed into the plug hole, in such a manner that a front end portion of the metallic shell is accommodated in a front end section of the plug hole with a clearance therebetween provided with a sealant so as to transmit heat from the spark plug to the cylinder head. The clearance is preferably given by the following expression: $0.005 \leqq D-d1 \leqq 0.05$, where D is an inner diameter (mm) of the front end section and d1 is an outer diameter (mm) of the front end portion. By this, the spark plug can be easily attached to the cylinder head and attain improved heat resistance.

19 Claims, 8 Drawing Sheets

SPARK PLUG ATTACHMENT STRUCTURE AND SPARK PLUG THEREFOR

BACKGROUND OF THE INVENTION

The present invention relates to a spark plug for an internal combustion engine and particularly a spark plug adapted to be fixed in a plug hole of a cylinder head without the necessity of being screwed into the plug hole. The present invention further relates to a structure for attaching such a spark plug to a cylinder head of an internal combustion engine. Hereinafter, the terms "front" and "rear" are used to indicate opposite sides of the spark plug that are nearer to and further from a spark gap thereof, respectively.

A spark plug is used in an internal combustion engine for a vehicle so as to ignite an air-fuel mixture in a combustion chamber of the engine.

An example of the spark plug is shown in FIG. 8. A spark plug 300 comprises a central electrode 303 extending axially of the spark plug 300, an insulator 302 surrounding the central electrode 303 and a tubular metallic shell 301 accommodating therein the insulator 302. The metallic shell 301 includes a front end portion 312 provided with a male thread 312*a* on an outer surface thereof and a protrusion 312*b* on an inner surface thereof, and a hexagon head portion 313. The insulator 302 has a step 302*a* engaged with the protrusion 312*b* via a packing 351. The metallic shell 301 thus retains therein the insulator 302 so as to prevent the insulator 302 from slipping out of the metallic shell 301 from the front side, and at the same time, to prevent the passage of air. The spark plug 300 further comprises a ground electrode 304 having one end joined to a front end of the front end portion 312 and the other end opposed to the central electrode 303 with a spark gap g therebetween. Herein, the section at which the ground electrode 304 is joined to the metallic shell 1 is referred to as a joint section 317.

The spark plug 300 is attached to a cylinder head of the engine. More specifically, the spark plug 300 is screwed into a plug hole of the cylinder head by a predetermined torque applied to the hexagon head portion 313 with the use of a wrench (not shown). Then, the spark plug 300 is fixed in the plug hole through engagement of the male thread 312*a* and a female thread of the plug hole.

In the above arrangement, when heat is applied to the central electrode 303 and the insulator 302, the heat is transmitted from the step 302*a* to the protrusion 312*b* via the packing 351, and then, transmitted from the metallic shell 301 to the cylinder head through the male thread 312*a* and the female thread.

However, if the spark plug 300 is screwed into the plug hole in such a way that the spark plug 300 forms an angle with respect to an axis of the plug hole, the male thread 312*a* and the female thread do not engage appropriately and causes so-called "galling". As a result, the male thread 312*a* and the female thread are damaged. In the worst case, a passage leaking combustion gas from the combustion chamber is formed, and the front end portion 312 of the metallic shell 301 and the central electrode 303 are heated excessively to high temperature. Various problems, such as preignition and electrode fusing, are thus caused.

In addition, if the ground electrode 304 is positioned so as to prevent swirl from flowing into the spark gap g in the combustion chamber at compression stroke, the spark plug 300 only ignites a relatively rich mixture. For this reason, the spark plug 300 is generally attached to the cylinder head in consideration of a positional relationship between the joint section 317 and the flow direction of swirl so that the ground electrode 304 is placed in a proper position and orientation. However, with the spark plug 300 screwed into the plug hole, it is difficult to determine the position of the joint section 317 (i.e., to determine the position and orientation of the ground electrode 304) in the combustion chamber.

SUMMARY OF THE INVENTION

In view of the foregoing, it is proposed to fix the spark plug in the plug hole by means of a plug fixing member without providing the spark plug and the plug hole with threads. This makes it possible to attach the spark plug to the cylinder head without any problems resulting from the engagement of the threads. In this case, some clearance needs to be created between the spark plug and the plug hole so that the spark plug is smoothly inserted into and detached from the plug hole. However, there arises a problem that heat cannot be easily transmitted from the spark plug to the cylinder head. More specifically, air remains in the clearance between the spark plug and the plug hole and functions as a thermal barrier. When the spark plug (especially, its central electrode and insulator) is subjected to high temperature owing to, e.g., combustion gas, the air in the clearance prevents the heat from being transmitted to the cylinder head. The spark plug is therefore excessively heated, and faces the problems of preignition, electrode fusing and the like.

It is therefore an object of the present invention to provide a spark plug adapted to be easily fixed in a plug hole of a cylinder head without the necessity of being screwed into the plug hole, and at the same time, having a good heat resistance so as to transmit heat rapidly to the cylinder head.

It is also an object of the present invention to provide a structure for attaching a spark plug to a cylinder head.

According to one aspect of the present invention, there is provided a spark plug attachment structure, comprising: a spark plug comprising a central electrode extending axially of the spark plug, an insulator surrounding the central electrode, and a metallic shell retaining therein the insulator and provided with a plug bearing surface and a front end portion on a front side of the plug bearing surface, the front end portion having a smooth cylindrical outer surface; a cylinder head defining therein a plug hole provided with a shoulder and a front end section having a smooth cylindrical inner surface, the spark plug having a clearance fit with the plug hole, with the plug bearing surface supported on the shoulder and the front end portion accommodated in the front end section, so as to provide a clearance between the cylindrical outer surface of the front end portion of the metallic shell and the cylindrical inner surface of the front end section of the plug hole; and a sealant provided in the clearance.

According to another aspect of the present invention, there is provided a spark plug for attachment to a cylinder head, the cylinder head defining therein a plug hole provided with a shoulder and a front end section having a smooth cylindrical inner surface, the spark plug comprising: a central electrode extending axially of the spark plug; an insulator surrounding the central electrode; and a metallic shell retaining therein the insulator and provided with a plug bearing surface and a front end portion on a front side of the plug bearing surface, the front end portion having a smooth cylindrical outer surface, the spark plug being adapted to have a clearance fit with the plug hole, with the plug bearing surface supported on the shoulder and the front end portion accommodated in the front end section, so as to provide a clearance between the cylindrical outer surface of the front end portion of the metallic shell and the cylindrical inner surface of the front end section of the plug hole to be provided with a sealant.

DESCRIPTION OF THE EMBODIMENTS

The present invention will be more clearly understood from the following description.

Firstly, a spark plug 100, a cylinder head SH1 and an attachment structure thereof according to a first embodiment of the invention will be described with reference to FIGS. 1 to 4.

Figure 1:
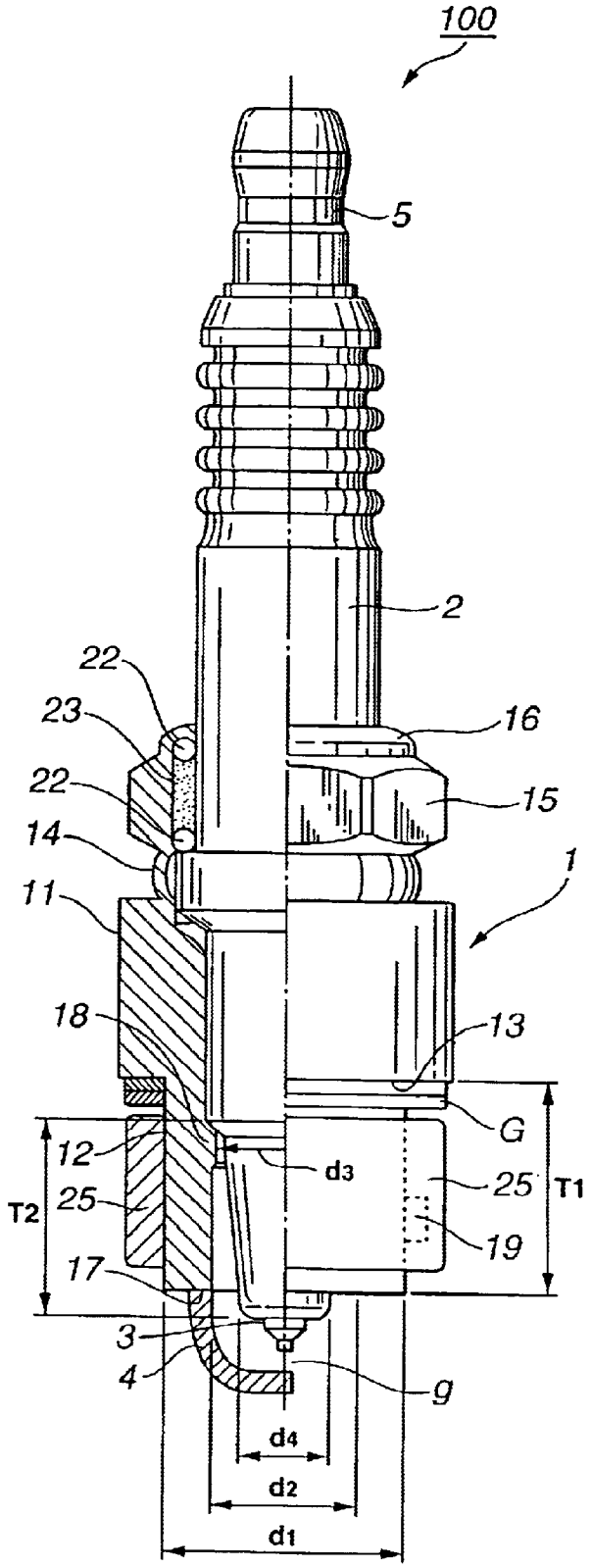
FIG. 1 is a half sectional view of a spark plug according to a first embodiment of the invention.
Figure 2:
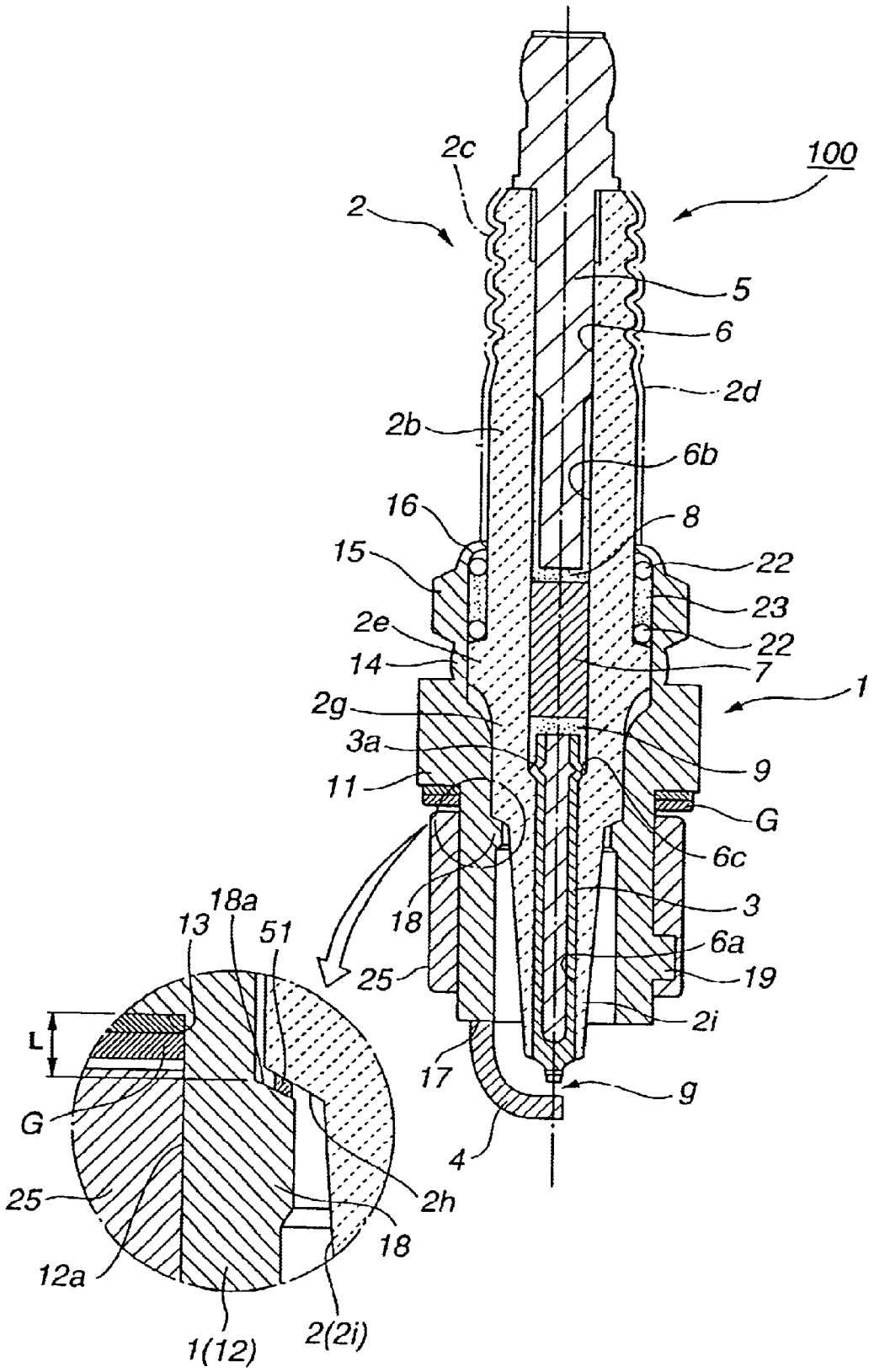
FIG. 2 is a sectional view of the spark plug according to the first embodiment of the invention.

As shown in FIGS. 1 and 2, the spark plug 100 comprises a metallic shell 1, an insulator 2 retained in the metallic shell 1, a central electrode 3 and a terminal electrode 5 both extending in the insulator 2 axially of the spark plug 100, and a single ground electrode 4.

The metallic shell 1 is made of, e.g., carbon steel, and includes a plug bearing portion 11 of a maximum outer diameter, a front end portion 12 on the front side of the plug bearing portion 11, and a tool engaging portion 15 on the rear side of the plug bearing portion 11. The plug bearing portion 11 has a plug bearing surface 13 at a front end face thereof, which is generally made flat. A ring-shaped gasket G is mounted on the plug bearing surface 13. The front end portion 12 is generally formed into a cylindrical shape so as to have a smooth cylindrical outer surface extending from the plug bearing surface 13 to a front end of the metallic shell 1 without any thread thereon. Further, a protrusion 18 is formed on an inner surface of the front end portion 12 of the metallic shell 1 so as to protrude inwardly, and has a retaining surface 18*a*. A pair of ring-shaped packings 22 is provided, with talc 23 being disposed between the metallic shell 1 and the insulator 2. A rear edge of the metallic shell 1 is caulked to the insulator 2 via the packing 22 to form a caulked portion 16, while the metallic shell 1 is caulked between the plug bearing portion 11 and the tool engaging portion 15 to the insulator 2 to form a caulked portion 14.

The insulator 2 includes a protruding portion 2*e* formed in the middle of the insulator 2 so as to protrude outwardly toward the metallic shell 1, a shell portion 2*b* on the rear side of the protruding portion 2*e* to be smaller in diameter than the protruding portion 2*e* and formed with corrugation 2*c*, and on the front side of the protruding portion 2*e* a first stem portion 2*g* smaller in diameter than the protruding portion 2*e* and a second stem portion 2*i* smaller in diameter than the first stem portion 2*g*. The shell portion 2*b* is covered with a glazing layer 2*d*. The second stem portion 2*i* is generally conical in shape and has an outer diameter gradually decreasing toward the front end. A step 2*h* is formed between the first stem portion 2*g* and the second stem portion 2*i*, and engaged with the retaining surface 18*a* of the protrusion 18 via a plate-shaped packing 51 so as to prevent the insulator 2 from slipping out of the metallic shell 1 from the front side. Further, the insulator 2 is formed with a through hole 6 throughout its length. The through hole 6 includes a first hole section 6*a* on the front side and a second hole section 6*b* having a diameter larger than that of the first hole section 6*a* on the rear side. An abutment surface 6*c* is formed between the first hole section 6*a* and the second hole section 6*b*. The abutment surface 6*c* may be tapered or curved.

The central electrode 3 has a projecting portion 3*a* at a rear end thereof, and is fitted in the first hole section 6*a* with the projecting portion 3*a* held by the abutment surface 6*c* and a front end thereof protruding from the insulator 2. The terminal electrode 5 is fitted in the second hole section 6*b* and electrically connected to the central electrode 3 via a ceramic resistor 7 and conductive glass seal layers 8 and 9 within the second hole section 6*b*. Alternately, the central electrode 3 and the terminal electrode 5 may be connected to each other via a single conductive glass seal layer without the ceramic resistor 7.

One end of the ground electrode 4 is joined to the front end of the metallic shell 1 at a joint section 17, and the other end of the ground electrode 4 faces the front end of the central electrode 3 so as to form a spark gap g therebetween.

Figure 3A:
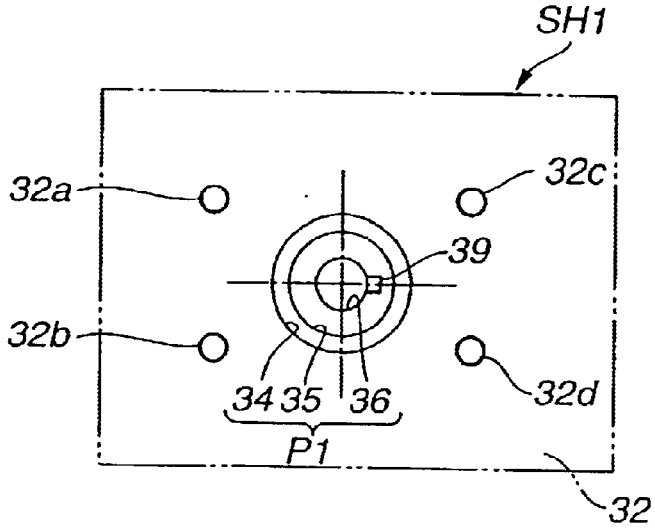
FIG. 3A is a partial plan view of a cylinder head used in to the first embodiment of the invention.
Figure 3B:
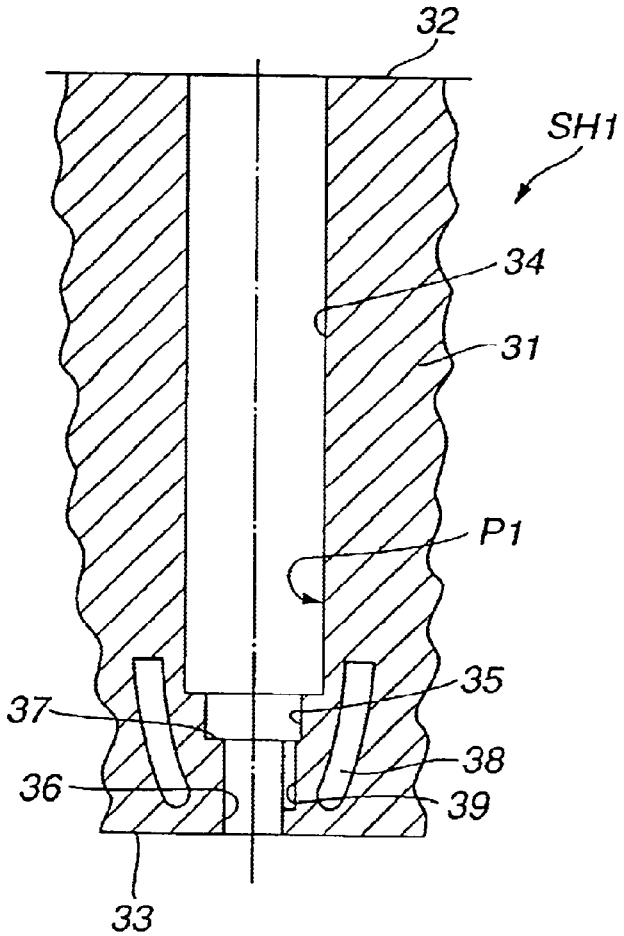
FIG. 3B is a partial sectional view of the cylinder head used in the first embodiment of the invention.
Figure 4:
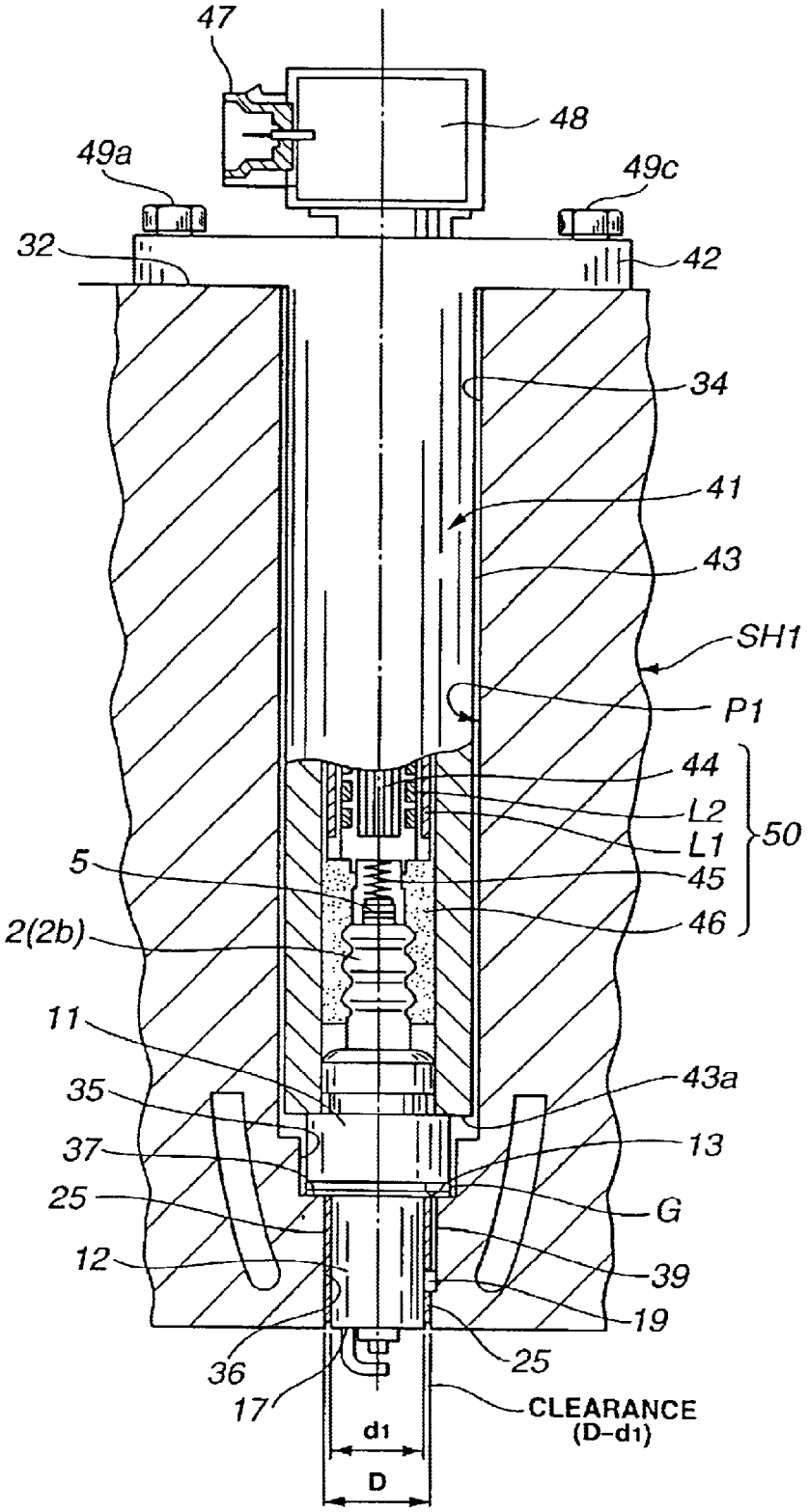
FIG. 4 shows a structure for fixing the spark plug in a plug hole of the cylinder head according to the first embodiment of the invention.

As shown in FIGS. 3A, 3B and 4, the cylinder head SH1 has a head body 31 provided with a plug hole P1 extending from a top surface 32 to a chamber-side surface 33 thereof. Threaded holes 32*a* to 32*d* are formed in the top surface 32 around the plug hole P1, and used for securing a plug fixing member 41 (described later) by bolts (only two bolts 49*a* and 49*c* are shown in FIG. 4). The plug hole P1 has such a depth that is large enough to accommodate therein the whole of the spark plug 100, and includes three sections: an insert section 34 near to the top surface 32, a receiving section 35 smaller in diameter than the insert section 34, and a front end section 36 smaller in diameter than the receiving section 35 and near to the chamber-side surface 33. The insert section 34 is generally circular and extends from the top surface 32 to a point near to the chamber-side surface 33. The diameter of the insertion section 34 is made larger than the outer diameter of the plug bearing portion 11 of the metallic shell 1. The receiving section 35 and the front end section 36 are shaped corresponding to the plug bearing portion 11 and the front end portion 12 of the metallic shell 1, respectively. The front end section 36 has a smooth cylindrical inner surface without any thread formed thereon. A shoulder 37 is formed between the receiving section 35 and the front end section 36 so as to receive the plug bearing surface 13 via the gasket G for sealing the spark plug 100 in the plug hole P1. Further, a cooling channel 38 is formed in the cylinder head SH1 for circulation of coolant therethrough.

In the present invention, the spark plug 100 has a clearance fit with the plug hole P1 so as to provide a clearance between the cylindrical outer surface of the front end portion 12 and the cylindrical inner surface of the front end section 36. A sealant 25 is provided in the clearance around the tip end portion 12 and so as to transmit the heat from the spark plug 100 to the cylinder head SH1. To be provided with the sealant 25, the clearance is preferably given by the following expression:

$$0.005 \leqq D - d1 \leqq 0.50$$

wherein D (mm) is an inner diameter of the front end section 36 and d1 (mm) is an outer diameter of the front end portion 12.

By such a clearance provided with the sealant 25, the spark plug 100 can transmit heat efficiently to the cylinder head SH1, and can have improved heat resistance and is therefore useful in various internal combustion engines including a high-powered engine. More preferably, for attaining further improved heat resistance, the clearance is given by the following expression:

$$0.075 \leqq D - d1 \leqq 0.40,$$

and most preferably $$0.075 \leqq D - d1 \leqq 0.15.$$

More specifically, the heat is diffused from the central electrode 3 and the insulator 2 to the metallic shell 1 via the protrusion 18 and then transmitted to the cylinder head SH1 via the sealant 25 and the contact between the plug bearing surface 13 of the metallic shell 1 and the shoulder 37 of the plug hole P1. In order to transmit the heat more efficiently, it is preferable that the plug bearing surface 13 and the protrusion 18 have a positional relationship given by the following expression:

$$L \geqq 0,$$

and more perferably $$0 \leqq L \leqq 6,$$

wherein L is an axial distance (mm) from the plug bearing surface 13 to a rear edge of the protrusion 18, and at the same time, the sealant 25 is placed on at least a part 12*a* of the outer surface of the front end portion 12 that axially corresponds in position to the protrusion 18.

The sealant 25 is required to have thermal properties of withstanding the service conditions (especially, high temperature conditions) of internal combustion engine. Preferably, the sealant 25 has heat resistance of 400° C. or higher. Also, the sealant 25 preferably contains at least one of metal powder, alloy powder and ceramic powder each having a thermal conductivity of 20 W/m·K or higher in order to rapidly transmit heat. The metal, alloy and/or ceramic powders may be mixed with viscous and/or elastic material. Specific examples of the metal powder include copper powder, aluminum powder, molybdenum powder or the like. Specific examples of the alloy powder include molybdenum disulfide and the like. Specific examples of the ceramic powder include aluminum nitride, boron nitride and the like. The metal, alloy and ceramic powders are not limited to the above, and may be any suitable powder having a thermal conductivity of 20 W/m·K or higher. Specific examples of the viscous material include lubricant such as grease, silicone oil, machine oil, mineral oil, dibasic acid ester and the like. Specific examples of the elastic material include heat-resistance gum material and the like. The total amount of the metal, alloy and ceramic powders contained in the sealant 25 is preferably within a range from 20 to 80% by weight based on the weight of the sealant 25. When the total amount of the metal, alloy and ceramic powders is less than 20% by weight, the sealant 25 may not exhibit sufficient ability to transmit heat from the metallic shell 1 to the cylinder head SH1. On the other hand, when the total amount of the metal, alloy and ceramic powders exceeds 80% by weight, the sealant 25 can transfer the heat rapidly to the cylinder head SH1, but not seal the clearance between the spark plug 100 and the plug hole P1 owing to deteriorated viscosity or elasticity thereof for lack of the viscous or elastic materials. Furthermore, each of the metal, alloy and ceramic powders preferably has an average particle size smaller than or equal to half of the clearance so that the sealant 25 maintains good viscosity or elasticity. For example, the sealant 25 has heat resistant of about 400° C., and comprises copper powder contained in mineral oil in an amount of 40% by weight based on the total weight of the sealant 25.

In addition, the metallic shell 1 is adapted to be engaged in the plug hole P1 at one or more places for determining a rotational position of the spark plug 100 relative to the plug hole P1. More specifically, the front end portion 12 and the front end section 36 have a key projection 19 (or ridge) and a key depression 39, respectively, formed so as to allow the joint section 17 to be disposed at a predetermined position relative to the flow direction of swirl in the combustion chamber upon engagement therebetween. Alternatively, the metallic shell 1 and the plug hole P1 may be provided with a plurality of projections 19 and a plurality of depressions 39 engageable with the projections 19, respectively. The metallic shell 1 and the plug hole P1 may be provided with at least one depression and at least one projection, respectively. The front end portion 12 of the metallic shell 1 may be chamfered, and the front end section 36 of the plug hole P1 may be shaped to fit with the chamfered front end portion 12. The metallic shell 1 and the plug hole P1 may be egg-shaped, oval-shaped or polygonal-shaped. The joint section 17 is formed in a particular position relative to the rotational position of the spark plug 100 so that the ground electrode 4 does not prevent the swirl from flowing into the spark gap g. This makes it possible to determine the position and orientation of the ground electrode 4 in the combustion chamber easily and properly.

Hereinafter, how to attach the spark plug 100 to the cylinder head SH1 will be explained below.

Before fitting the spark plug 100 in the plug hole P1, the sealant 25 is applied to the outer surfaces of the front end portion 12 and the key projection 19. It is not necessary to apply the sealant 25 to the whole of the outer surface of the front end portion 12, and the sealant 25 may be applied to a part of the outer surface of the front end portion 12 as described above. In this case, it is preferable to apply the sealant 25 to a front part of the outer surface of the front end portion 12 so that the sealant 25 spreads through the clearance when the spark plug 100 is being inserted in the plug hole P1.

Then, the spark plug 100 is inserted into the plug hole P1 so that the key projection 19 is engaged in the key depression 39 and the plug bearing portion 11 and the front end portion 12 of the metal shell 1 are accommodated in the receiving section 35 and the front end section 36 of the plug hole P1, respectively. As described above, the ground electrode 304 is positioned so as not to interfere with the flow of swirl by the engagement between the key projection 19 and the key depression 39. Further, the plug bearing surface 13 is seated on the shoulder 37 via the gasket G.

While the spark plug 100 is inserted into the plug hole P1, the sealant 25 applied to the outer surface of the front end portion 12 spreads because of viscosity thereof so as to fill in the clearance between the outer surface of the front end portion 12 and the inner surface of the front end section 36 in this embodiment.

Then, the spark plug 100 is secured to the cylinder head SH1 by means of the plug fixing member 41.

The plug fixing member 41 is generally made of metal, and includes a flange portion 42 used for securing the plug fixing member 41 to the cylinder head SH1 and a tube portion 43 generally formed into a cylindrical shape as shown in FIG. 4. Holes (not shown) are formed in the flange portion 42 so as to correspond to the threaded holes 32*a* to 32*d*. The tube portion 43 has an outer diameter slightly smaller than the diameter of the insert section 34 of the plug hole P1 as well as an inner diameter larger than the outer diameter of the tool engaging portion 15, and accommodates therein an ignition coil unit 50. The ignition coil unit 50 has a core coil 44, a primary winding L1, a secondary winding L2, a connection terminal 45 in the form of a coil spring, and an insulating element 46 generally made of heat-resistant rubber. The primary and secondary windings L1 and L2 are wound around the core coil 44, while one end of the secondary winding L2 is connected to the connection terminal though so not shown. Further, the plug fixing member 41 is provided with a connector 47 connected to external devices (such as a power source and a ECU, not shown) and an ignition switch 48 accommodating therein a switching element (not shown) for controlling current supply from the power source.

The above-structured plug fixing member 41 is set by inserting the tube portion 43 into the plug hole P1 until the front end face 43*a* contacts with the rear end face of the plug bearing portion 11 of the metallic shell 1. In this state, the connection terminal 45 electrically connects the secondary winding L2 to the terminal electrode 5 so as to supply high discharge voltage while being held against the spring tension. Further, the insulating element 46 is brought into contact with the shell portion 2*b* of the insulator 2, thereby providing electrical insulation between the spark plug 100 and the ignition coil unit 50. Then, the plug fixing member 41 is disposed so that the holes of the flange portion 42 are positioned correspondingly to the threaded holes 32*a* to 32*d*, and is then secured by screwing the bolts (including the bolts 49*a* and 49*c*) into the threaded holes 32*a* to 32*d* through the holes. The plug bearing portion 11 of the metallic shell 1 is pushed down with the front end face 43*a* of the tube portion 43, thereby sealing a gap between the plug bearing surface 13 and the shoulder 37 with the gasket G. Herein, the length of the tube portion 43 has been previously adjusted according to the dimensions of the spark plug 100 and the plug hole P1, so that the front end face 43 pushes the rear end face of the plug bearing portion 11 with a predetermined pressure. Simultaneously with securing the plug fixing member 41, the ignition coil unit 50 can be arranged in the plug hole P1. Since a high-tension cable is not needed for electrically connecting the spark plug 100 with the ignition coil unit 50, noise reduction will result.

As described above, the spark plug 100 is clearance fitted in the plug hole P1 with the clearance between the outer surface of the front end portion 12 and the inner surface of the front end section 36 of the plug hole P1 being given by the following expression: $0.005 \leqq D-d1 \leqq 0.50$ and filled with the sealant 25. For example, the clearance (D−d1) is 0.15 mm, when D and d1 are 13.70 mm and 13.55 mm, respectively. Herein, the diameters D and d1 are determined without including the depression 39 and the projection 19, respectively. The protrusion 18 is disposed at a position given by the following expression: $L \geqq 0$. For example, the distance L is set to 0.5 mm. At the same time, the sealant 25 is placed on at least the part 12*a* of the outer surface of the front end portion 12 that axially corresponds in position to the protrusion 18.

With the above-described arrangement, heat applied to the central electrode 3 and the insulator 2 (especially, the second stem portion 2*i*) is transferred to the metallic shell 1 via the step 2*h*, the protrusion 18 and the packing 51. Heat is also applied to the ground electrode 4 and transferred to the metallic shell 1. Then, the heat is diffused through the metallic shell 1 and transmitted from the front end portion 12 and the plug bearing surface 13 to the cylinder head SH1 via the sealant 25. This makes it possible to keep the central electrode 3, the insulator 2 and the ground electrode 4 at low temperature. The spark plug 100 can therefore attain heat resistance equal to or higher than conventional with great ability to transmit the heat to the cylinder head SH1. Upon the engagement between the key projection 19 and the key depression 39, the ground electrode 4 is positioned so as not to prevent swirl from flowing into the spark gap g. Thus, the spark plug 100 can attain high and stable ingitionability, thus being capable of igniting even a lean mixture assuredly.

Figure 5:
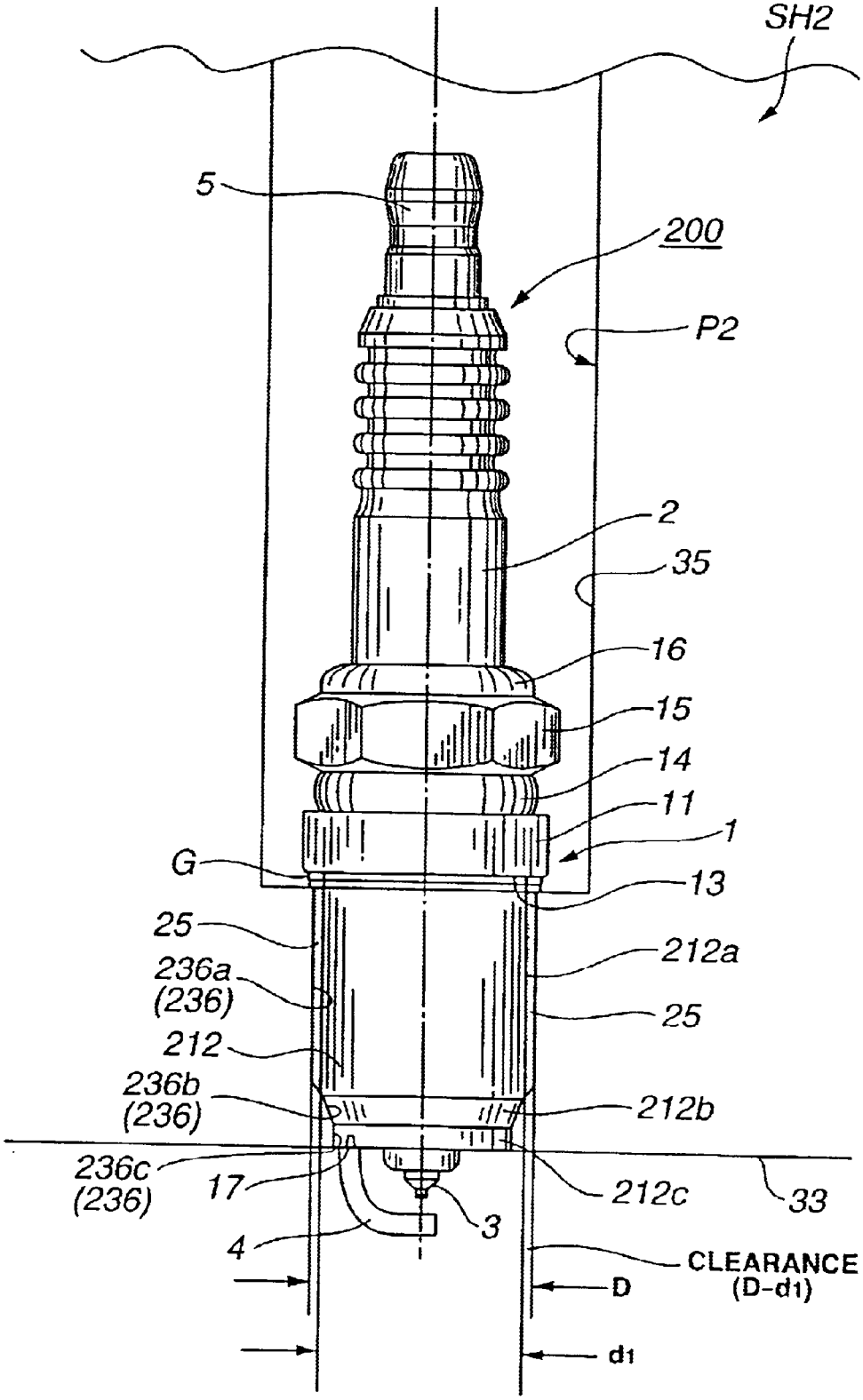
FIG. 5 shows a spark plug fitted in a plug hole of a cylinder head according to a second embodiment of the invention.

Next, a spark plug 200 and a cylinder head SH2 according to a second embodiment of the invention will be described with reference to FIG. 5. Herein, like parts and portions are designated by like reference numerals in the drawings and repeated descriptions thereof are omitted.

The metallic shell 1 of the spark plug 200 has a front end portion 212 shaped differently from the front end portion 12 of the first embodiment. More specifically, the front end portion 212 includes a first cylindrical part 212*a* extending from the plug bearing surface 13, a tapered part 212*b* on the front side of the first end part 212*a*, and a second cylindrical part 212*c* on the front side of the tapered part 212*b*. The tapered part 212*b* is generally conical with an outer diameter gradually decreasing toward the front end. Further, the outer diameter of the plug bearing portion 11 is smaller than that of the tool engaging portion 15.

In the cylinder head SH2, a plug hole P2 is formed so as to correspond to the front end portion 212 of the metallic shell 1. The plug hole P2 includes only two section: a receiving section 35 and a front end section 236. The front end section 236 has a first cylindrical region 236*a*, a tapered region 236*b* and a second cylindrical region 236*c* that correspond to the first cylindrical part 212*a*, the tapered part 212*b* and the second cylindrical part 212*c*, respectively. A clearance is created between the outer surface of the first cylindrical part 212*a* and the inner surface of the first cylindrical region 236*b*. The clearance (D−d1) is controlled to from 0.005 to 0.50 mm. On the other hand, the tapered part 212*b* and the tapered region 236 are formed so as to come in contact with each other. Likewise, the second cylindrical part 212*c* and the second cylindrical region 236*c* are formed so as to come in contact with each other.

The spark plug 200 is secured to the cylinder head SH2 by a plug fixing member (not shown) in such a manner that the sealant 25 is interposed between the outer surface of the first cylindrical part 212*a* and the inner surface of the first cylindrical region 236*b*.

In the above arrangement, when heat is applied to the central electrode 3, the insulator 2 and the ground electrode 4 and flows into the metallic shell 1, the sealant 25 rapidly transmits the heat to the cylinder head SH2. It is thus possible to attain improved heat resistance of the spark plug 200. Further, the sealant 25 is prevented from falling off to enter the combustion chamber during the use of the spark plug 200 by the contacts between the tapered part 212*b* and the tapered region 236*b* and between the second cylindrical part 212*c* and the second cylindrical region 236*c*. The spark plug 200 is therefore more reliable.

The present invention will be more specifically illustrated by way of the following example.

EXAMPLE

Herein, how the heat resistance (i.e., the resistance to preignition) of the spark plug 100 varies with changes in the clearance (D−d1) was evaluated using a preignition tester (not shown).

The following are the dimensions of the plug hole P1 and samples of the spark plug 100 used in the evaluation (refer to FIG. 1).

Plug hole P1

Inner diameter D of the front end section 36: 13.7 mm (constant)

Spark plug 100

Outer diameter d1 of the front end portion 12: variable

Length T1 of the front end portion 12: 15.0 mm

Inner diameter d2 of the front end portion 12: 8.4 mm

Minimum inner diameter d3 of the protrusion 18: 7.5 mm

Figure 6:
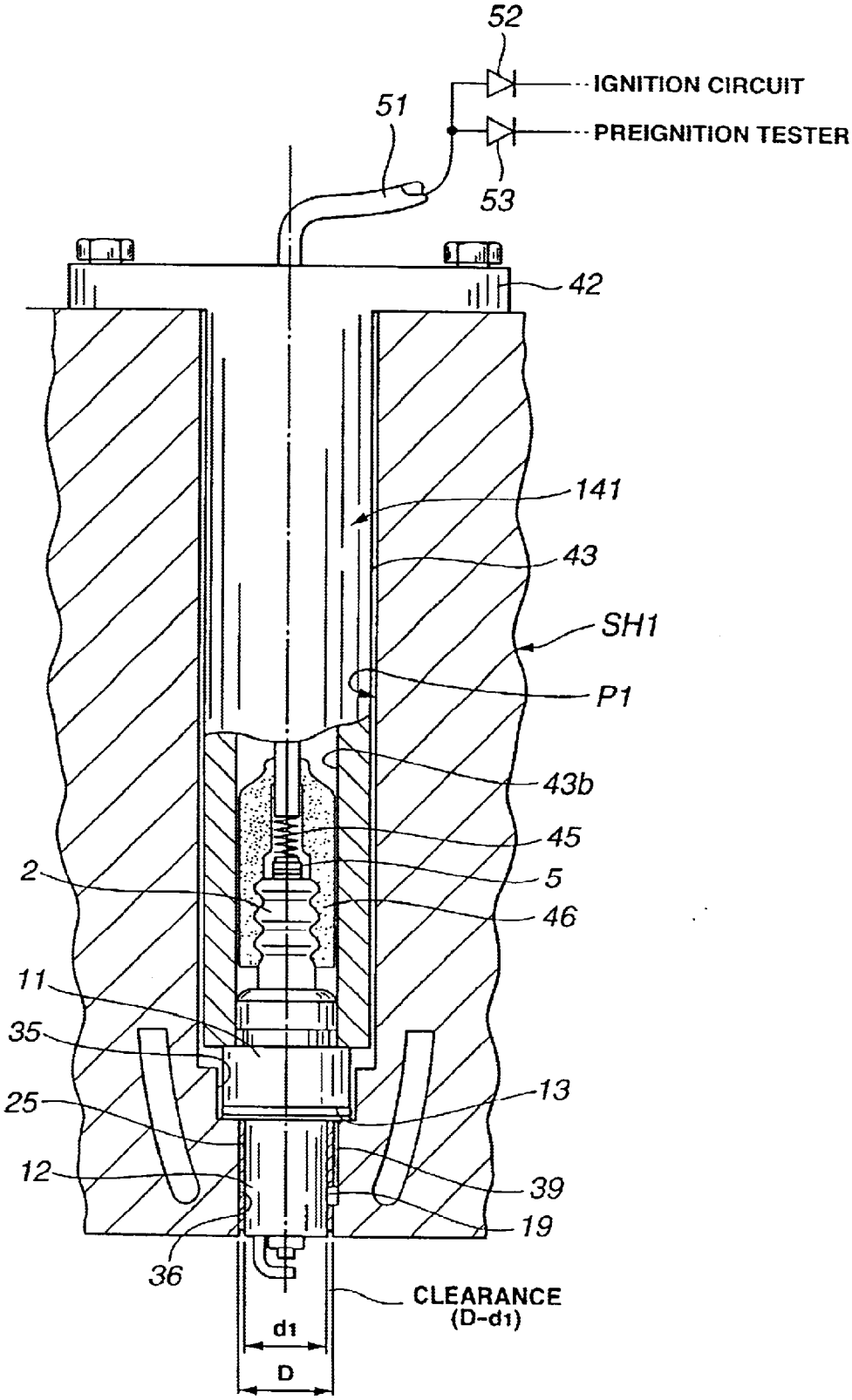
FIG. 6 shows a test system for preignition.

Length L between the plug bearing surface 13 and the rear end of the protrusion 18: 0.5 mm Length T2 of the second stem portion 2*i*: 17 mm Outer diameter d4 of the front end of the second stem portion 2*i*: 5.1 mm As shown in FIG. 6, a test system was prepared. More specifically, the spark plug 100 was secured to the cylinder head SH1 by means of a plug fixing member 141, while the sealant 25 is provided in the clearance between the outer surface of the front end portion 12 and the inner surface of the front end section 36. The plug fixing member 141 is the same in structure as the above-mentioned plug fixing member 41, except that part of ignition coil unit 50 was removed and a hole 43*b* is formed with an opening in the flange portion 42 so as to continue to the inner surface of the tube portion 43. Two ends of the connection terminal 45 were electrically connected to the terminal electrode 5 and one end of a cable 51, respectively, under spring tension thereof. The other end of the cable 51 was electrically connected to an ignition circuit (not shown) and the preignition tester via diodes 52 and 53, respectively.

The preignition tester is for measuring so-called ion current. When preignition occurs thereby generating a flame at the spark gap g, the spark gap g is brought into conduction by means of ions in the flame. Thus, the ion current is fed upon applying voltage of several hundreds volts. The preignition tester determines that preignition occurs by detecting the ion current before the ignition occurred through the ignition circuit.

Using the above-described test system, internal combustion engine (2000 cc displacement, in-line four-cylinder engine) was driven at full throttle. Ignition advance was gradually changed by one degree. While driving the engine for two minutes at each advanced ignition timing, it was monitored whether preignition occurred. The advance by which preignition occurred was determined to be AD1.

Next, the same procedure was repeated, except that the sealant 25 was not interposed between the outer surface of the front end portion 12 and the inner surface of the front end section 36 of the plug hole P1. The advance by which preignition occurred was determined to be AD2.

Figure 7:
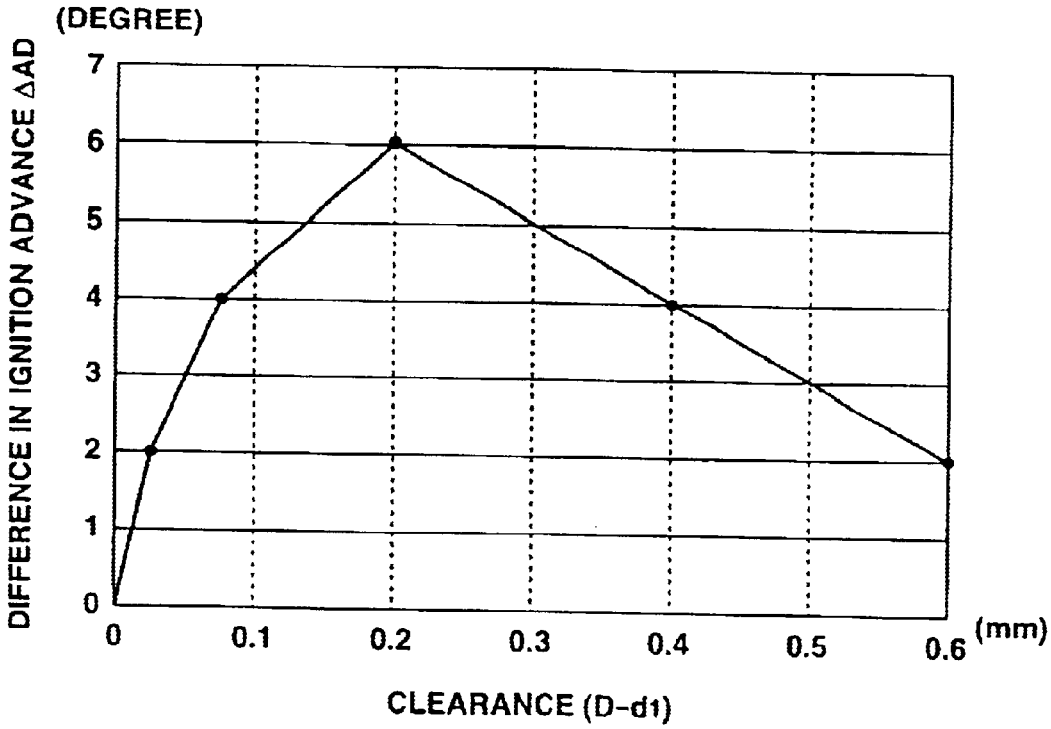
FIG. 7 is a graph showing an improvement in heat resistance of the spark plug with respect to the clearance between the spark plug and the plug hole.
Figure 8:
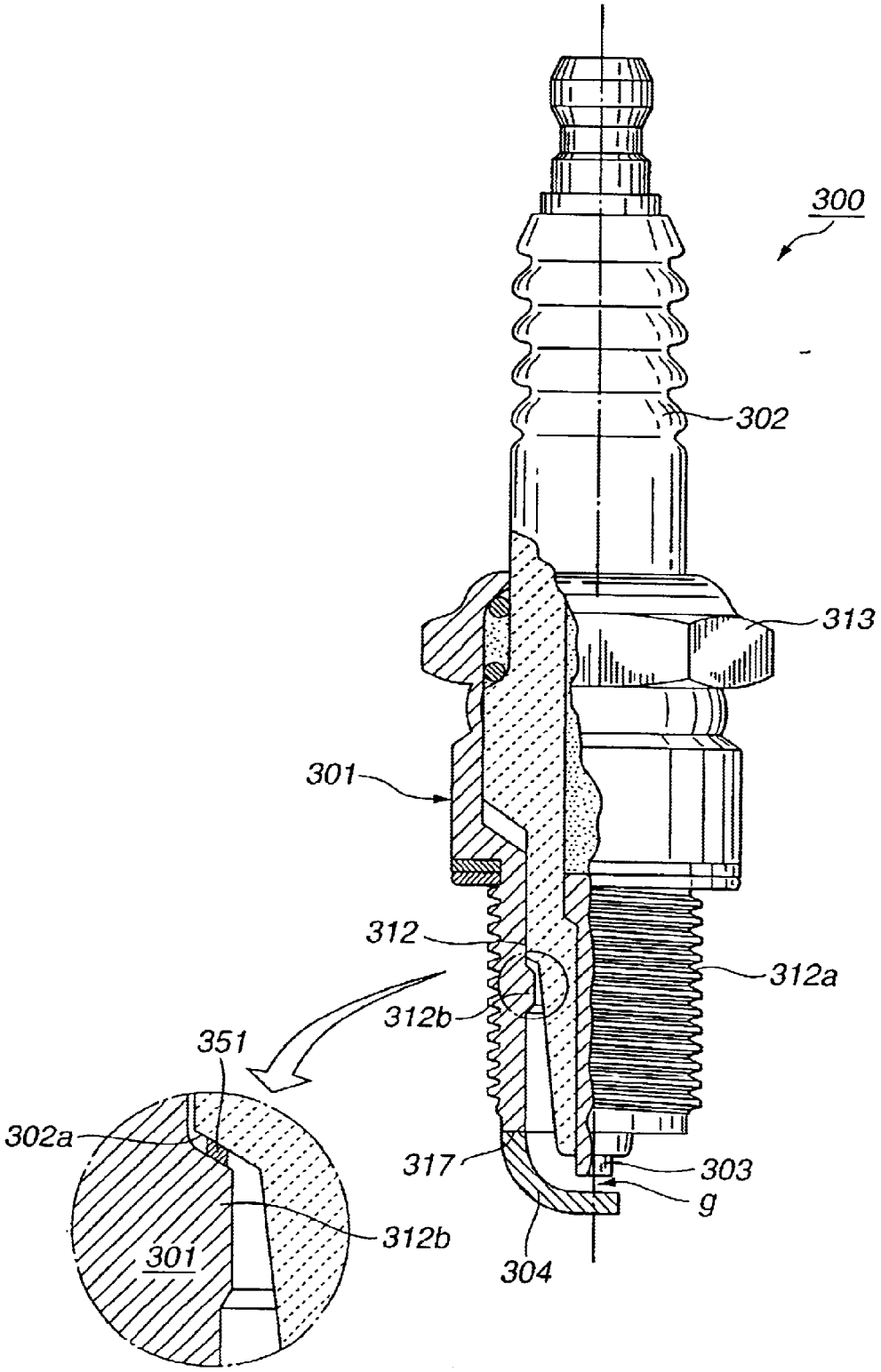
FIG.8 PRIOR ART
FIG. 8 is a partial sectional view of a conventional spark plug.

Differences between AD1 and AD2 were calculated as ΔAD, and are shown in FIG. 7. The larger value of ΔAD means that the heat resistance of the spark plug 100 was highly improved.

It is clear from FIG. 7 that when the clearance (D−d1) was in a range from 0.005 to 0.50 mm, the heat resistance (i.e., resistance to preignition) of the spark plug 100 was improved. When the clearance (D−d1) is in a range from 0.075 to 0.40 mm, the heat resistance of the spark plug 100 was further improved.

As is apparent from the foregoing, the spark plug of the present invention is easily and reliably fit in the plug hole without the necessity of being screwed in the plug hole, and is therefore free from problems associated with the engagement of the male and female threads. Particularly, DOHC engine currently in the mainstream is often equipped with intake and exhaust valves that are large in area, and the plug hole is designed to be situated in the recesses of the cylinder head. The spark plug of the present invention is easily and reliably fit even in such a recessed plug hole. If the spark plug needs replacing, the used spark plug is easily removed from the plug hole, and then, a new one is easily fit in the plug hole. In addition, the inner diameter of the plug hole can be made smaller than conventional because of forming the plug hole with no female thread. Thus, the intake and exhaust valves are allowed to stand nearer to the axis of a cylinder, thereby providing a wider range of engine design. Further, the sealant links the front end portion of the metallic shell and the front end section of the plug hole while avoiding the existence of air. That is, the heat applied to the central electrode and the insulator and diffused to the metallic shell therefrom is rapidly transmitted from the front end portion of the metallic shell to the cylinder head via the sealant. The insulator and the central electrode are thus kept at low temperature, whereby the spark plug can attain heat resistance equal to or higher than conventional without the possibility of preignition, electrode fusing and the like. Also, it is possible to minimize variations in the heat resistance of the spark plugs, which results from difference in clearances, and at the same time, to prevent the passage of combustion gas from a combustion chamber unfailingly so as to improve gastightness. Furthermore, the spark plug and the plug hole are shaped so as to position the ground electrode so as not to prevent swirl from flowing into the spark gap g, whereby the swirl can be certainly brought in contact with a flame kernel of spark discharge at the spark gap g. Therefore, the spark plug can ignite not only a rich mixture but also a lean mixture reliably. It is also possible minimize variations in ingitionability from cylinder to cylinder and from engine to engine so that ignition occurs at a constant air-fuel ratio and possible to improve fuel efficiency.

Although the invention has been described with reference to the specific embodiments thereof, the invention is not limited to the above-described embodiments. Various modification and variation of the embodiments described above will occur to those skilled in the art in light of the above teaching. For example, the spark plug may comprise a plurality of ground electrodes. Further, the plug bearing surface of the metallic shell may be tapered, and may seated on the shoulder of the plug hole with no gasket therebetween. The front end portion of the metallic shell can be formed into any tubular shape without being limited to a cylindrical shape. It is noted that if the front end portion of the metallic shell is formed into a shape other than a cylindrical shape, "the outer diameter d1 of the front end portion" and "the inner diameter D of the front end section" mean a maximum outer diameter of the front end portion and an inner diameter of the front end section corresponding to the maximum outer diameter of the front end portion, respectively. The scope of the invention is defined with reference to the following claims.

What is claimed is:

1. A spark plug attachment structure, comprising:

a spark plug comprising a central electrode extending axially of the spark plug, an insulator surrounding the central electrode, and a metallic shell retaining therein the insulator and provided with a plug bearing surface and a front end portion on a front side of the plug bearing surface, the front end portion having a smooth cylindrical outer surface;

a cylinder head defining therein a plug hole provided with a shoulder and a front end section having a smooth cylindrical inner surface, the spark plug having a clearance fit with the plug hole, with the plug bearing surface supported on the shoulder and the front end portion accommodated in the front end section, so as to provide a clearance between the cylindrical outer surface of the front end portion of the metallic shell and the cylindrical inner surface of the front end section of the plug hole; and a sealant provided in the clearance.

2. A spark plug attachment structure according to claim 1, wherein the clearance is given by the following expression:

$$0.005 \leqq D - d1 \leqq 0.50$$

where D is an inner diameter (mm) of the front end section of the plug hole and d1 is an outer diameter (mm) of the front end portion of the metallic shell.

3. A spark plug attachment structure according to claim 2, wherein the clearance is given by the following expression:

$$0.075 \leqq D - d1 \leqq 0.40.$$

4. A spark plug attachment structure according to claim 3, wherein the clearance is given by the following expression:

$$0.075 \leqq D - d1 \leqq 0.15.$$

5. A spark plug attachment structure according to claim 1, wherein the sealant comprises material having a thermal conductivity of 20 W/m·K or higher.

6. A spark plug attachment structure according to claim 5, wherein the material is at least one selected from the group consisting of metal, alloy and ceramic.

7. A spark plug attachment structure according to claim 6, wherein the material is contained in the sealant in an amount of 20 to 80% by weight based on a total weight of the sealant.

8. A spark plug attachment structure according to claim 1, wherein the front end portion of the metallic shell has a protrusion formed on an inner surface thereof for retaining the insulator, the protrusion being disposed at a position given by the following expression:

$$L \geqq 0$$

where L is an axial distance (mm) from the plug bearing surface to a rear edge of the protrusion, and the sealant is placed on at least a part of the outer surface of the front end portion that axially corresponds in position to the protrusion.

9. A spark plug attachment structure according to claim 1, wherein the spark plug further comprises at least one ground electrode having one end joined to the metallic shell at a joint section and the other end facing a front end of the central electrode so as to form a spark gap therebetween, the metallic shell is adapted to be engaged in the plug hole at one or more places for determining a rotational position of the spark plug relative to the plug hole, and the joint section is in a particular position relative to the rotational position of the spark plug.

10. A plug attachment structure according to claim 1, wherein the front end portion of the metallic shell includes a cylindrical part and a tapered part connected to a front end of the cylindrical part and having an outer diameter gradually decreasing toward a front end thereof, the front end section of the plug hole includes a cylindrical region that have a clearance fit with the cylindrical part and a tapered region that comes in contact with the tapered part, and the sealant fills the clearance between the cylindrical part of the metallic shell and the cylindrical region of the plug hole.

11. A spark plug for attachment to a cylinder head, the cylinder head defining therein a plug hole provided with a shoulder and a front end section having a smooth cylindrical inner surface, the spark plug comprising:

a central electrode extending axially of the spark plug;

an insulator surrounding the central electrode; and a metallic shell retaining therein the insulator and provided with a plug bearing surface and a front end portion on a front side of the plug bearing surface, the front end portion having a smooth cylindrical outer surface, the spark plug being adapted to have a clearance fit with the plug hole, with the plug bearing surface supported on the shoulder and the front end portion accommodated in the front end section, so as to provide a clearance between the cylindrical outer surface of the front end portion of the metallic shell and the cylindrical inner surface of the front end section of the plug hole to be provided with a sealant.

12. A spark plug according to claim 11, wherein the clearance is given by the following expression:

$$0.005 \leqq D - d1 \leqq 0.50$$

where D is an inner diameter (mm) of the front end section of the plug hole and d1 is an outer diameter (mm) of the front end portion of the metallic shell.

13. A spark plug according to claim 12, wherein the clearance is given by the following expression:

$$0.075 \leqq D - d1 \leqq 0.40.$$

14. A spark plug according to claim 13, wherein the clearance is given by the following expression:

$$0.075 \leqq D - d1 \leqq 0.15.$$

15. A spark plug according to claim 11, wherein the sealant comprises material having a thermal conductivity of 20 W/m·K or higher.

16. A spark plug according to claim 15, wherein the material is at least one selected from the group consisting of metal, alloy and ceramic.

17. A spark plug according to claim 16, wherein the material is contained in the sealant in an amount of 20 to 80% by weight based on a total weight of the sealant.

18. A spark plug according to claim 11, wherein the front end portion of the metallic shell has a protrusion formed on an inner surface thereof for retaining the insulator, the protrusion being disposed at a position given by the following expression:

$$L \geqq 0$$

where L is an axial distance (mm) from the plug bearing surface to a rear edge of the protrusion, and the sealant is placed on at least a part of the outer surface of the front end portion that axially corresponds in position to the protrusion.

19. A spark plug according to claim 11, further comprising at least one ground electrode having one end joined to the metallic shell at a joint section and the other end facing the front end of the central electrode so as to form a spark gap therebetween, wherein the metallic shell is adapted to be engaged in the plug hole at one or more places for determining a rotational position of the spark plug relative to the plug hole, and the joint section is in a particular position relative to the rotational position of the spark plug.

* * * * *